US007220103B2

(12) United States Patent
Cunha et al.

(10) Patent No.: US 7,220,103 B2
(45) Date of Patent: May 22, 2007

(54) IMPINGEMENT COOLING OF LARGE FILLET OF AN AIRFOIL

(75) Inventors: Frank J. Cunha, Avon, CT (US); Jason E. Albert, West Hartford, CT (US); Edward F. Pietraszkiewicz, Southington, CT (US)

(73) Assignee: United Technologies Corporation, Hartford, CT (US)

( * ) Notice: Subject to any disclaimer, the term of this patent is extended or adjusted under 35 U.S.C. 154(b) by 173 days.

(21) Appl. No.: 10/967,557

(22) Filed: Oct. 18, 2004

(65) Prior Publication Data

US 2006/0083613 A1 Apr. 20, 2006

(51) Int. Cl.
*F01D 5/18* (2006.01)

(52) U.S. Cl. ..... 416/97 R; 416/193 A

(58) Field of Classification Search ..... 416/97 R, 416/193 A, 248; 415/115
See application file for complete search history.

(56) References Cited

U.S. PATENT DOCUMENTS 3,628,885 A 12/1971 Sidenstick et al.
3,867,068 A 2/1975 Corsmeier et al.
5,340,278 A * 8/1994 Magowan ..... 416/96 R
5,403,159 A * 4/1995 Green et al. ..... 416/97 R
5,634,766 A 6/1997 Cunha et al.
6,139,269 A * 10/2000 Liang ..... 416/97 R
6,382,908 B1 * 5/2002 Keith et al. ..... 415/115
6,830,432 B1 * 12/2004 Scott et al. ..... 416/97 R

FOREIGN PATENT DOCUMENTS

| | | |
|---|---|---|
| EP | 0 302 810 | 2/1989 |
| EP | 1 160 418 | 12/2001 |
| EP | 1 221 538 | 7/2002 |
| GB | 2 384 275 | 7/2003 |

* cited by examiner

*Primary Examiner*—Ninh H. Nguyen
(74) *Attorney, Agent, or Firm*—Wall Marjama & Bilinski LLP

(57) ABSTRACT

A gas turbine engine blade has a relatively large fillet to improve the characteristics of the air flow thereover. The fillet has a thin wall which, together with an impingement rib, defines a fillet cavity therebetween, and cooling air is provided to flow through impingement holes in the impingement rib and impinge on the rear surface of the fillet. The impingement holes are elongated in cross sectional shape with their elongations being orient in a direction generally transverse to a radial direction.

17 Claims, 3 Drawing Sheets

IMPINGEMENT COOLING OF LARGE FILLET OF AN AIRFOIL

BACKGROUND OF THE INVENTION

This invention relates generally to turbine blades, and more particularly, to turbine blades with a large fillet and associated cooling features.

Present turbine blade design configurations include little or no leading edge fillets at the transition between the blade and the associated platform. As a result, several gas path vortices are developed in this region so as to cause hot gases to be trapped in certain areas of the airfoil, thereby resulting in severe distress to those regions.

One way to alleviate the problem is to introduce large fillets that have a substantial radius such that the gas path vortices are substantially eliminated. A large fillet on the other hand, will tend to add metal and therefore mass to the blade. Such an increase in thermal mass in a fluid area would have negative effects in terms of centrifugal loading and thermal stress fatigue and creep. It is therefore desirable to not only substantially increase the fillet radius but also to reduce the mass that is associated with a larger fillet, and to also provide proper cooling for this area.

SUMMARY OF THE INVENTION

Briefly, in accordance with one aspect of the invention, the thickness of the relatively large fillet is minimized to reduce its mass the impingement cavity behind the leading edge is extend radially inwardly and curve forwardly behind an substantial conformity with the curve of the fillet.

In accordance with another aspect of the invention, the impingement cavity flattens and widens as it extends towards its radially inner end to thereby provide improved cooling to the fillet.

In accordance with another aspect of the invention, the impingement cavity is defined on its one side by an impingement rib having impingement holes that are elongated in cross sectional form.

In accordance with another aspect of the invention, the impingement holes near the blade leading edge are orientated with their elongations radially aligned, and those impingement holes adjacent the fillet are aligned with their elongations in the transverse direction.

In the drawings as hereinafter described, preferred and alternate embodiments are depicted; however, various other modifications and alternate constructions can be made thereto without departing from the true spirit and scope of the invention.

DESCRIPTION OF THE PREFERRED EMBODIMENT

Figure 1A:
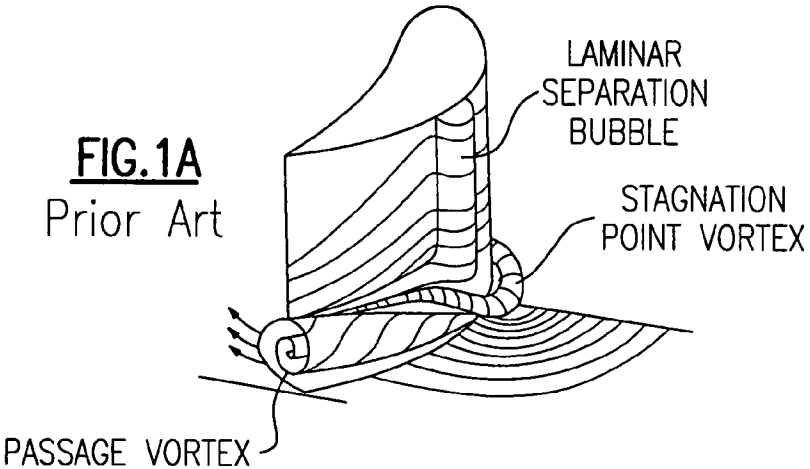
FIG.1A Prior Art
FIGS. 1A and 1B are schematic illustrations of vortex flow models for turbine blades in accordance with the prior art.
Figure 1B:
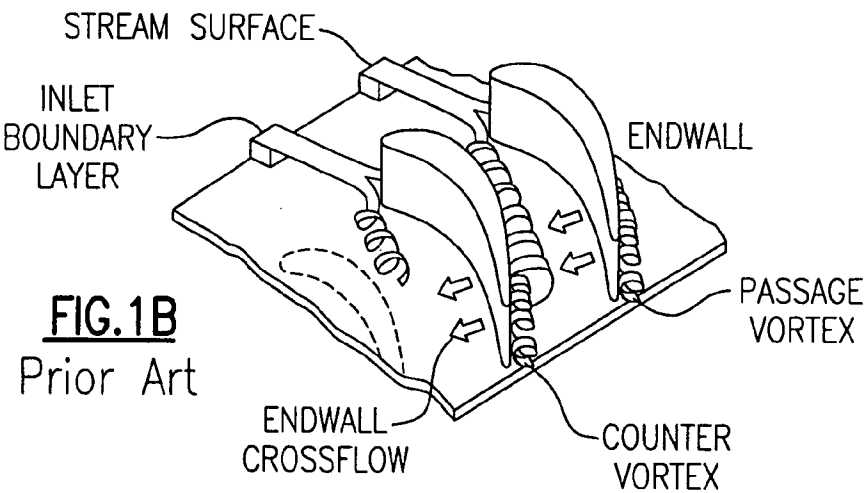
FIG.1B Prior Art

Referring now to FIGS. 1A and 1B, there is shown an artist's conception of a vortex structure that results from the flow of hot gases over a turbine blade having no fillet (i.e. with the blade portion intersecting with the platform section at substantially an orthogonal angle). Here, it will be seen, that because of laminar separation that occurs, secondary flow vortices are formed such that hot gases can be trapped on the suction side of the airfoils as shown, and these can then result in severe distress in these regions.

Figure 2:
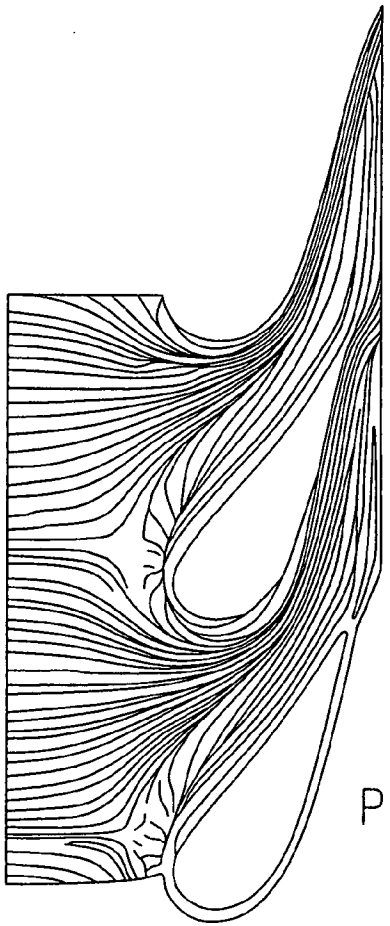
FIG.2 Prior Art
FIG. 2 is a top view of a turbine blade showing the streamlines flowing therearound in accordance with the prior art.

In FIG. 2, there is shown a computational fluid dynamics simulation of the streamlines of gases passing around an airfoil having little or no fillet as discussed hereinabove. Here again, there is evidence of secondary flow vortices that tend to affect the thermal load to the airfoil.

Figure 3A:
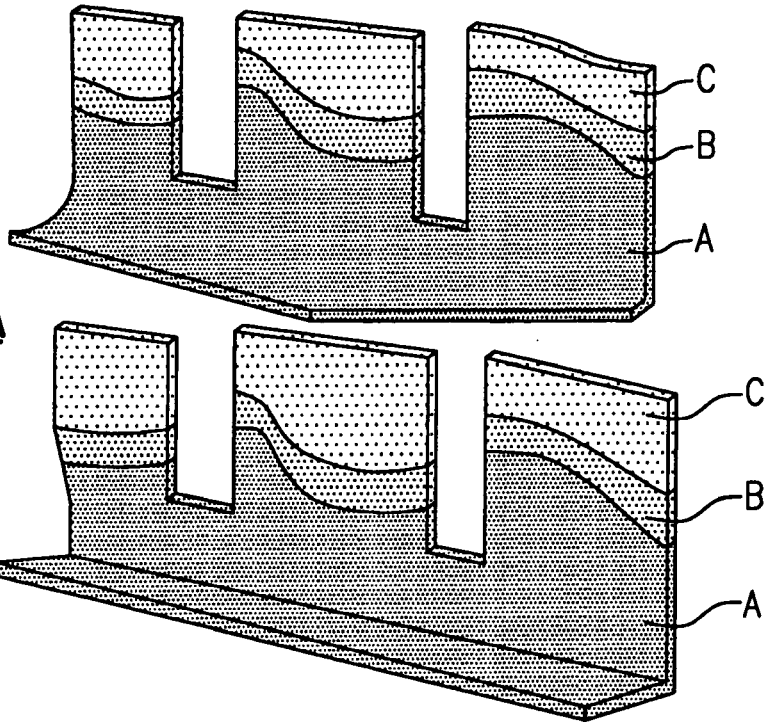
FIG. 3A shows comparisons of gas temperature reductions between large and small fillet blades.

In an effort to address the problems discussed hereinabove, the airfoil was modified to include a leading edge fillet with a substantial radius. For example, present blade design configurations use leading edge fillets to the blade platforms with a radius, or offset, in the range of 0.080 inches or less. In accordance with the present design of increased fillet size, a fillet is provided having a radius that may be as high as a quarter of the size of the entire radial span or about ⅜ inches or higher. This modification has been found to improve the flow characteristics of the airfoil and to thereby substantially reduce the temperatures in the fillet region. For example, in FIG. 3A, there is shown a color coded indication of temperatures in three gradations, A, B and C for both an airfoil with no fillet (at the bottom) and one with a large fillet (at the top). In each of these, the cooler range of temperatures is shown by the darker colors A at the bottom and the hotter temperature ranges are shown by the lighter colors C at the top. As will be recognized, the gas temperatures flowing over the modified airfoil (i.e. with a fillet) has a substantially greater portion in the cooler zone A than the airfoil without the fillet. This is the result of the fillet tending to suppress the end wall vortices.

Figure 3B:
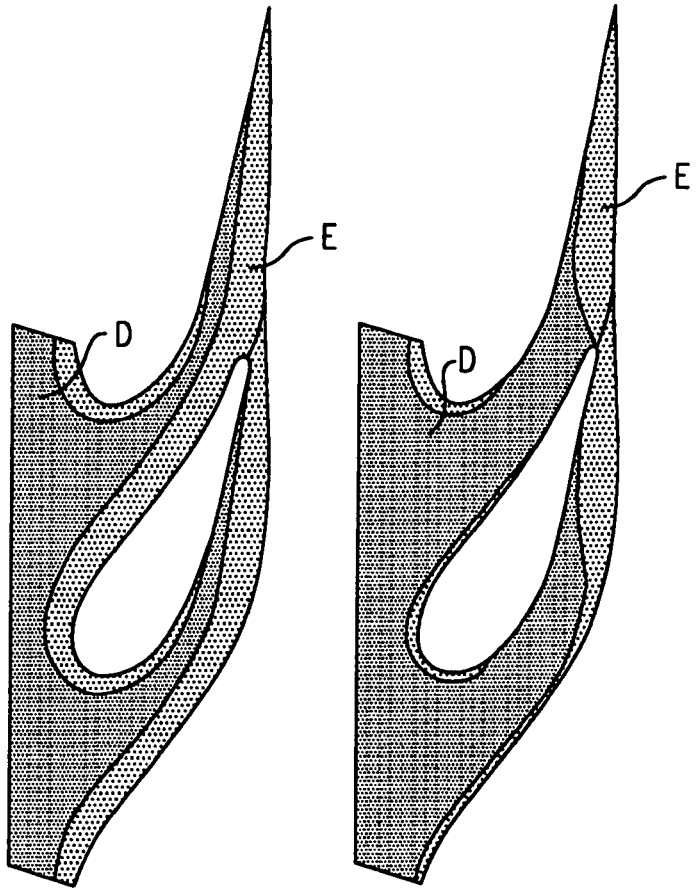
FIG. 3B shows comparisons of adiabatic wall temperatures between large and small fillet blades.

Similarly, in FIG. 3B, wherein there is shown a comparison of adiabatic wall temperatures between an airfoil having no fillet (as shown at the left) and one with the fillet (as shown at the right). In each case, the darker portion D is indication of cooler temperature range and the lighter portion E is indicative of a higher temperature range. Again, it will be seen that the adiabatic wall temperatures of the airfoil having a fillet are substantially reduced from those of the airfoil having no fillet.

Although the use of larger fillets successfully addresses the problem of the secondary flow vortices as discussed hereinabove, the use of such large fillets can also introduce other problems associated with the design and use of an airfoil. Generally, it will be understood that the introduction of a larger fillet will also increase the amount of metal that is in the airfoil. This substantial increase in the mass in the area of the fillet could have a negative effect in terms of centrifugal loading and thermal stress, fatigue and creep. The present invention therefore addresses this problem by reducing the mass of the larger fillet blade and providing for various cooling features that have been found effective in cooling the large fillet leading edges.

Figure 4A:
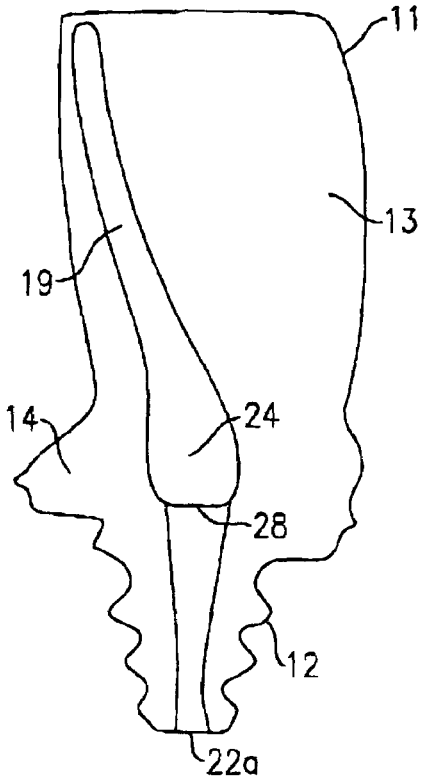
FIGS. 4A and 4B are cutaway views of a large fillet blade in accordance with the present invention.
Figure 4B:
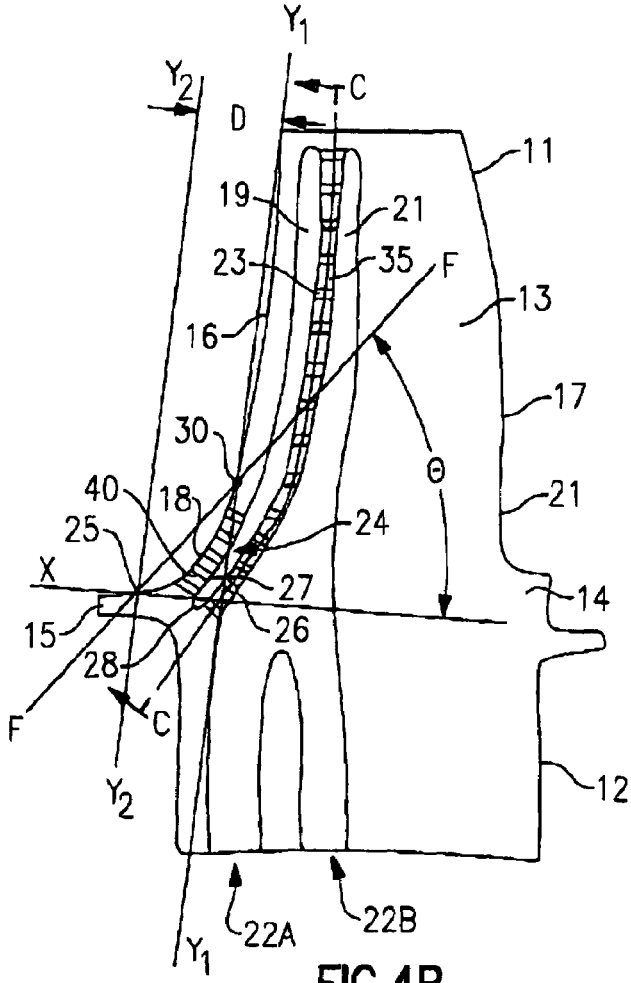

Referring now to FIGS. 4A and 4B, wherein a turbine blade 11 is shown in a front view and a side view, respectively, the turbine blade 11 has a fir tree 12 for attaching the blade 11 to a rotating member such as a disk, an airfoil portion 13 and a platform 14 having a leading edge 15 and a trailing edge 20 that define a plane x—x. The airfoil portion 13 has a pressure side (i.e. concave side) and a suction side (i.e. convex side), a leading edge 16 that defines a plane $Y_1$—$Y_1$ that is substantially orthogonal to plane x—x and a trailing edge 17. At the point where the leading edge 16 transitions into and is attached to the platform 14, there is a relatively large-radius fillet 18 that extends from a point 25 on the platform 14 to a point 30 on the leading edge 16 as shown. The distance D defines the offset between the plane $Y_1$—$Y_1$ and a plane $Y_2$—$Y_2$ that is parallel to plane $Y_1$—$Y_1$ and passes through point 25. A fillet line F—F extending between points 25 and 30 and forming a fillet angle of θ defines the extent of the fillet 18. In accordance with the present invention the large fillet 18 is defined by the parameters D and θ with the offset D being in the range of 0.080" to 0.375" and the fillet angle θ being in the range of 10° to 60°. It is this large radius fillet that overcomes the problems of end wall vortices as discussed hereinabove.

As is conventional in these types of blades, there is provided behind the leading edge wall a leading edge cavity 19, and parallel to that is a coolant supply cavity 21. The coolant supply cavity 21 is supplied with a source of cooling air that flows up through a pair of radial passages 22A and 22B which pass through the fir tree 12. The coolant supply cavity 21 is fluidly connected to the leading edge cavity 19 by a plurality of impingement cooling passages 23. These impingement cooling passages 23 are formed in what eventually becomes an impingement rib 35 during the casting process by the insertion of small ceramic core rods which are subsequently removed to leave the impingement cooling passages 23. Thus, the cooling air passes through the radial passages 22A and 22B and into the coolant supply cavity 21. It then passes through the impingement cooling passages 23 and into the leading edge cavity 19 where it impinges on the inner surface of the leading edge before being discharged to the outside of the blade by way of film holes. In accordance with one aspect of the present invention, the leading edge cavity 19 extends downwardly toward the platform 14 into an expanded fillet cavity 24 directly behind the fillet 18. The coolant supply cavity 21 is fluidly connected to the fillet cavity 24 by impingement holes 26 formed in the lower portion of the impingement rib 35.

In operation, cooling air is introduced into the radial passages 22A and 22B, passes into the supply cavity 21 on the back side of the impingement rib 35 and then a portion of the cooling air passes through the impingement cooling passages 23 to cool the leading edge 16 of the blade and a portion thereof passes through the impingement holes 26 to impinge on the inner surface 27 of the fillet 18 and then flow through film cooking holes formed in the fillet 18.

Considering now some of the features of the present invention, it will be recognized that the radial passage 22A is radially aligned with the impingement holes 26 at the lower portion of the impingement rib 35 such that the cooling air flowing through the radial passage 22A impinges directly on the impingement holes 26 leading to the impingement cavity 24, where it impinges on the fillet inner surface 27, such that effective cooling of the inner wall 27 of the fillet 18 can be accomplished.

Another feature that tends to enhance the cooling function is that of the fillet cavity 24 being wider toward its radially inner end 28 as shown in FIG. 4A, and also flattened towards its radially inner end as shown in FIG. 4B. That is, as the fillet cavity 24 approaches its inner end 28, the distance between the impingement rib 35 and the fillet inner wall 27 decreases so as to place the impingement holes 26 closer to the inner wall 27. By making the fillet cavity 24 as wide as possible, a wider area of the large fillet 18 is cooled by impingement and more metal is removed from the large fillet 18, thereby resulting in less mass, stress and creep damage in the blade and attachment.

Figure 4C:
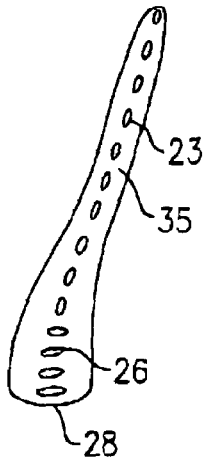
FIG. 4C is a sectional view as seen along lines CC of FIG. 4B.

Another feature of the present invention is shown in FIG. 4C wherein the impingement cooling passages 23 in the radially outer portion of the impingement rib 35, are elongated in form, with the elongations aligned substantially radially as shown. In the radially inner portion of the impingement ribs 35, however, the impingement holes 26 are elongated in the lateral direction as shown to thereby more effectively cool the full width of the large fillet 18.

The shape of the elongated impingement cooling passages 23 and the impingement holes 26 can be of any generally oval shape such as elliptical or racetrack in form. The limiting factor for how thin and wide the fillet cavity 24 can be made is the geometric constraints of the casting process for the core. A minimum corner radius and draft angle is required for the core features which will dictate a minimum thickness for a given width of the fillet cavity 24.

While the present invention has been particularly shown and described with reference to preferred and alternate embodiments as illustrated in the drawings, it will be understood by one skilled in the art that various changes in detail may be effected therein without departing from the true spirit and scope of the invention as defined by the claims.

We claim:

1. A gas turbine engine component comprising:

a fir tree for mounting the component to a rotatable disk;

a platform connected to said fir tree and extending in a first plane between a leading edge and a trailing edge;

an airfoil interconnected to said platform by a fillet extending at an acute angle from said platform first plane to a leading edge of the airfoil extending along a second plane substantially orthogonal to said first plane, said fillet being so formed so as to curve forwardly as it extends radially inwardly and having an inner wall surface;

an impingement rib disposed adjacent to said fillet inner wall surface to jointly form a fillet cavity therebetween, said impingement rib being so formed as to curve forwardly as it extends radially inwardly in close proximity to said fillet and having a plurality of impingement holes formed therein for conducting the flow of cooling air to impinge on said fillet inner wall surface; and a generally radially extending supply air passage formed in said fir tree for conducting the flow of cooling air to one side of said impingement rib, so as to pass through said plurality of impingement holes and impinge on said fillet inner wall surface.

2. A gas turbine engine component as set forth in claim 1 wherein said acute angle is in the range of 10° to 60°.

3. A gas turbine engine component as set forth in claim 1 wherein the extent of said fillet is defined by an offset distance defined by the distance between a first point in which the fillet intersected with said first plane and a second point in which the fillet intersects with said second plane s measured along a plane parallel the said first lane, and further wherein the offset distance is in the range of 0.080" to 0.375".

4. A gas turbine engine component as set forth in claim 1 wherein said supply air passage is fluidly connected to a supply air cavity on a rear side of said impingement rib.

5. A gas turbine engine component as set forth in claim 4 wherein said supply air cavity is fluidly interconnected to a leading edge cavity by a plurality of impingement cooling passages.

6. A gas turbine engine component as set forth in claim 5 wherein said impingement cooling passages have cross sectional shapes that are elongated in form.

7. A gas turbine engine component as set forth in claim 6 wherein said elongated shapes are generally aligned in a radial direction.

8. A gas turbine engine component as set forth in claim 1 wherein said supply air passage is generally radially aligned with said plurality of impingement holes so as to impinge thereon.

9. A gas turbine engine component as set forth in claim 1 wherein said plurality of impingement holes are generally elongated in cross sectional shape.

10. A gas turbine engine component as set forth in claim 9 wherein said elongated shapes are aligned generally transverse to the radial direction.

11. A gas turbine engine component of the type having:

an airfoil with a leading edge, a leading edge cavity, an impingement rib, and a coolant supply cavity, with the coolant supply cavity being supplied with coolant air by way of a coolant supply passage and said coolant supply cavity being fluidly interconnected to said leading edge cavity by way of a plurality of impingement cooling passages formed in the impingement rib;

wherein, said airfoil has a fillet interconnected to a radially inner end of the leading edge said fillet being formed so as to curve forwardly as it extends radially inwardly to a platform and further wherein said leading edge cavity and said impingement rib are so formed as to curve forwardly as they extend radially inwardly in close proximity to said fillet and with said impingement rib having a plurality of impingement holes for conducting the flow of cooling air to impinge on said fillet.

12. A gas turbine engine component as set forth in claim 11 wherein both said airfoil and said fillet have a plurality of film cooling holes for conducting the flow of coolant air to an outer surface thereof.

13. A gas turbine engine component as set forth in claim 11 wherein said supply air passage is generally radially aligned with said plurality of impingement holes so as to impinge thereon.

14. A gas turbine engine component as set forth in claim 11 wherein said plurality of impingement holes are generally elongated in cross sectional shape.

15. A gas turbine engine component as set forth in claim 14 wherein said elongated shapes are aligned generally transversely to the radial direction.

16. A gas turbine engine component as set forth in claim 15 wherein said impingement cooling passages have cross sectional shapes that are elongated in form.

17. A gas turbine engine component as set forth in claim 16 wherein said elongated impingement cooling passages are generally aligned in a radial direction.

* * * * *